US005533486A

United States Patent [19]

Qutub

[11] Patent Number: 5,533,486

[45] Date of Patent: Jul. 9, 1996

[54] FUEL SYSTEM FOR HEATING AND COOLING FUEL

[75] Inventor: Ibrahim Qutub, Beaverton, Oreg.

[73] Assignee: Freightliner Corporation, Portland, Oreg.

[21] Appl. No.: 173,667

[22] Filed: Dec. 23, 1993

[51] Int. Cl.[6] ..... F02M 15/00

[52] U.S. Cl. ..... 123/541; 123/514

[58] Field of Search ..... 123/514, 557, 123/541, 509, 510, 516

[56] References Cited

U.S. PATENT DOCUMENTS

| | | | |
|---|---|---|---|
| 4,072,138 | 2/1978 | Hawkins et al. | 123/122 |
| 4,385,615 | 5/1983 | Keane | 123/514 |
| 4,411,239 | 10/1983 | Kelch | 123/557 |
| 4,454,851 | 6/1984 | Bourbonnaud et al. | 123/557 |
| 4,481,931 | 11/1984 | Bruner | 123/514 |
| 4,499,886 | 2/1985 | Hinds | 123/557 |
| 4,700,047 | 10/1987 | Crossett et al. | 219/205 |
| 4,748,960 | 6/1988 | Wolf | 123/549 |
| 4,842,006 | 6/1989 | Scheurenbrand | 123/514 |
| 4,964,376 | 10/1990 | Veach et al. | 123/557 |
| 5,042,447 | 8/1991 | Stone | 123/557 |
| 5,069,062 | 12/1991 | Malecek et al. | 73/49.7 |
| 5,181,319 | 1/1993 | Campbell | 29/890.053 |
| 5,277,166 | 1/1994 | Freeland | 123/514 |
| 5,303,685 | 4/1994 | Forgas | 123/514 |

FOREIGN PATENT DOCUMENTS

| | | | |
|---|---|---|---|
| 1225934 | 8/1987 | Canada | 182/77 |
| WO89/07791 | 8/1989 | WIPO | G05D 23/02 |

*Primary Examiner*—Carl S. Miller

*Attorney, Agent, or Firm*—Klarquist, Sparkman Campbell Leigh & Whinston

[57] ABSTRACT

A fuel system has a fuel tank with a wall and a fuel delivery outlet through which fuel is delivered to the engine. The fuel tank has a fuel suction tube extending from the fuel delivery outlet into the fuel tank. Fuel is drawn to the engine from the fuel tank through the suction tube and the fuel delivery outlet. The fuel tank has a fuel cooling return inlet through which unused fuel warmed by the engine may be returned to the fuel tank and cooled. A fuel cooling conduit is coupled to the fuel cooling return inlet. The fuel cooling conduit has at least one fuel dispersing outlet through which fuel is dispersed onto the fuel tank wall to cool the fuel. A fuel warming return inlet is provided through which unused fuel warmed by the engine may be directed to flow adjacent the suction tube to heat the fuel being delivered through the suction tube to the engine. A shroud may also be provided to blend returning warm fuel with cooler fuel from the fuel tank that is flowing toward the suction tube.

30 Claims, 3 Drawing Sheets

FIG. 4
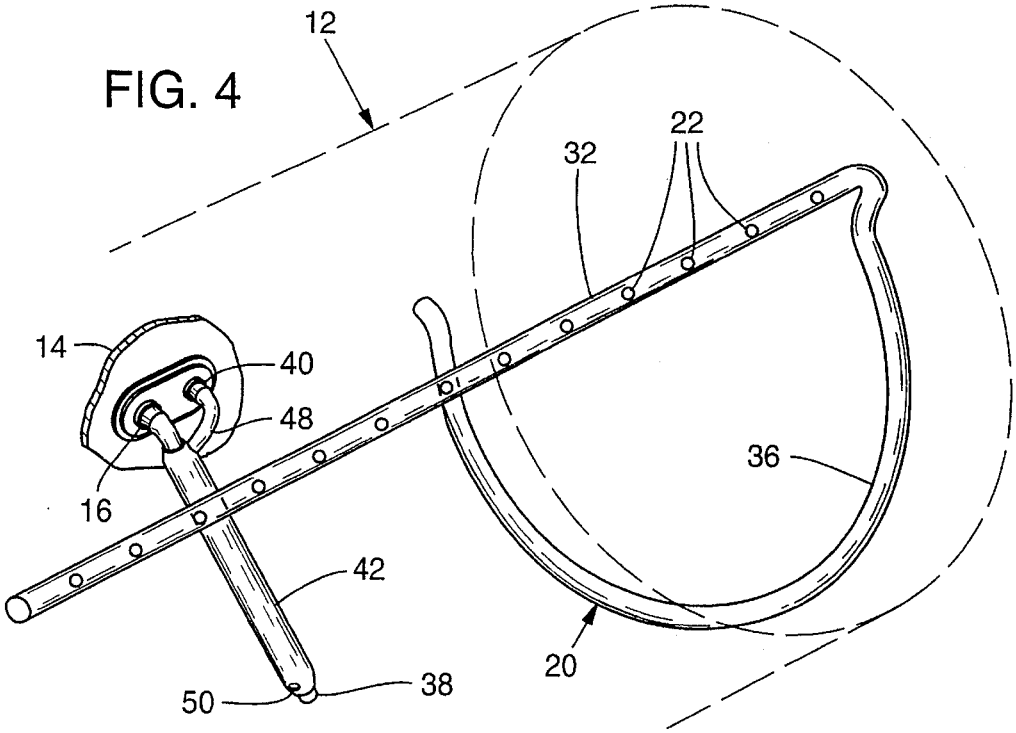
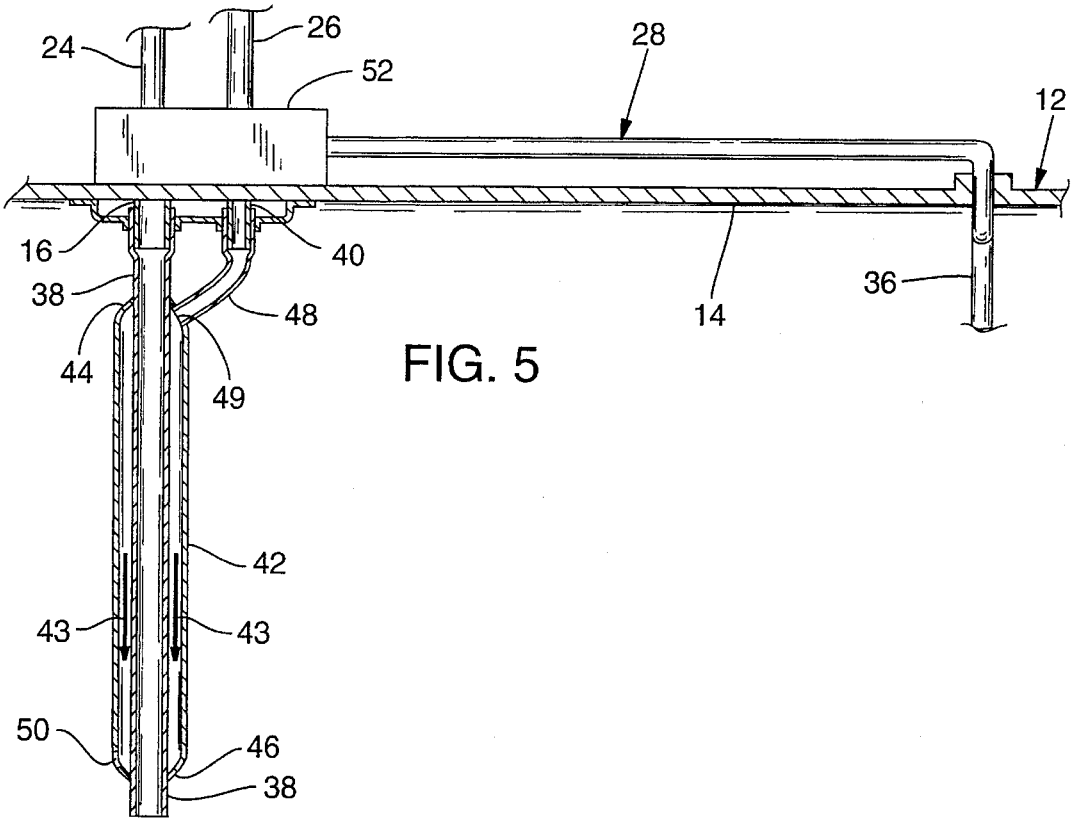
FIG. 5

FUEL SYSTEM FOR HEATING AND COOLING FUEL

TECHNICAL FIELD

The present invention relates to a fuel system for heating fuel, cooling fuel, or both heating and cooling fuel for the efficient operation of internal combustion engines.

BACKGROUND OF THE INVENTION

Engines, especially diesel engines, operate most efficiently when the fuel delivered to the engines is maintained within a desired temperature range. The low end of the desired range is above low fuel temperatures at which fuel may thicken (wax). The high end of the desired temperature range is below high fuel temperatures at which engine power output deteriorates.

Fuel waxing is apt to occur during cold weather, when the fuel tank of a vehicle is exposed to the environment. Under such conditions, fuel in the fuel tank may thicken. Such thickened fuel may clog the engine fuel inlet lines. The clogging may result in compromised engine performance or engine shutdown. The small fuel lines of electronic fuel injectors prevalent today are especially vulnerable to such clogging.

Engine power output may deteriorate when the fuel being delivered to the engine becomes excessively warm. For example, the power output of diesel engines may decline by one horsepower for every 10° F. of fuel temperature over 100° F. Moreover, over-heated fuel may be detrimental when fuel is used to cool engine equipment, such as in a heat exchange relationship with electronic engine controls. Such over-heated fuel may inadequately cool the engine equipment, resulting in a reduced service life for that equipment.

Fuel tends to become excessively heated when stored in a vehicle fuel tank during very hot weather. Fuel also becomes overheated when used to cool engine equipment. As much as 80% of the fuel directed from the fuel tank to the engine is returned unused (uncombusted) by the engine and is used for equipment cooling as the fuel is returned to the fuel tank. The fuel picks up heat from equipment being cooled, which tends to increase the temperature of the fuel.

Therefore, it is desirable to maintain the fuel delivered from the fuel tank within a temperature range that minimizes problems associated with waxing, degraded power output and inadequate engine equipment cooling.

One prior art approach uses radiators to cool the fuel. However, radiators tend to be expensive and prone to damage. Another approach uses a two fuel tank system to address the problem of hot fuel that is recycled from the engine. The first tank receives the hot recycled fuel for storage and gradual cooling, and the other tank receives cooled fuel from the first tank for delivery to the engine. This approach has a drawback in that, on very warm days, the fuel in the tanks may not cool adequately. Moreover, when the fuel level in the tanks is low, the hot fuel may not be stored in the cooling tank long enough for adequate cooling. Furthermore, these approaches do not address the problem of fuel that is too cold.

U.S. Pat. No. 4,748,968 to Wolf discloses a fuel heating device in which relatively hot engine coolant circulates around a fuel tank suction tube to warm fuel taken from the fuel tank. The Wolf device requires a coolant fluid circuit extending between the cooling system and the fuel tank.

U.S. Pat. No. 5,042,447 to Stone discloses a thermostatically controlled fuel heater and cooler. The Stone device monitors the fuel temperature and appropriately directs the fuel into a fuel heating heat exchanger utilizing relatively hot engine coolant for heating, or a fuel cooling heat exchanger utilizing a refrigerant for cooling. The coolant and refrigerant of the Stone device circulate through lines which are linked into the engine cooling system, and the air conditioning system, respectively. Consequently, the Stone device adds to the complexity of these systems.

A need exists for an improved apparatus for temperature control of fuel which overcomes these and other disadvantages of the prior art.

SUMMARY OF THE INVENTION

It is one object of the present invention to provide an improved fuel system for adjusting fuel temperature of fuel utilized by an internal combustion engine.

It is another object of the present invention to either heat fuel utilized by an engine, cool fuel utilized by an engine, or selectively heat or cool fuel utilized by an engine.

A secondary object of the present invention is to provide such a fuel system of simple construction.

Another secondary objective of this invention is to provide a fuel system for fuel cooling and/or heating that is concealed within a fuel tank for protection against damage.

A fuel system in accordance with one aspect of the present invention has a fuel tank with a fuel delivery outlet through which fuel is delivered to an engine. The fuel tank has a fuel cooling return inlet through which unused fuel warmed by the engine is returned to the fuel tank. A fuel cooling conduit may be coupled to the fuel cooling return inlet. The fuel cooling conduit has at least one fuel dispersing outlet through which fuel is dispersed against a heat dissipation surface, such as a wall of the fuel tank, to cool the fuel.

The fuel tank may have a fuel suction tube extending from the fuel delivery outlet into the fuel tank. Fuel is drawn to the engine from the fuel tank through the suction tube and the fuel delivery outlet. The tank has a fuel warming return inlet through which unused fuel warmed by the engine may be returned to the fuel tank. The warmed fuel may be guided by a fuel flow guide to blend with and heat fuel from the tank which is then delivered to the fuel delivery outlet and to the engine. Preferably, the unused warm fuel passes in heat transfer relationship to the suction tube so as to heat the fuel in the suction tube.

In accordance with another aspect of the present invention, a shroud may be provided over a portion of the fuel warming conduit and suction tube. The shroud defines a blending chamber in which heated fuel returning from the engine is blended with cooler fuel from the fuel tank. The warm fuel blend is then directed into the suction tube for delivery to the engine.

The present invention relates to the above-described objects and features individually, as well as collectively. These and other features, objects and advantages of the present invention will become apparent with reference to the following description and drawings.

BRIEF DESCRIPTION OF DRAWINGS

FIG. 4 is a cutaway perspective view of the fuel system in accordance with one preferred embodiment of the present invention, with the outline of a portion of a fuel tank being shown in dashed lines.

FIG. 5 is a cutaway, cross-sectional side elevational view of a fuel system in accordance with one preferred embodiment of the present invention.

DETAILED DESCRIPTION

Figure 1:
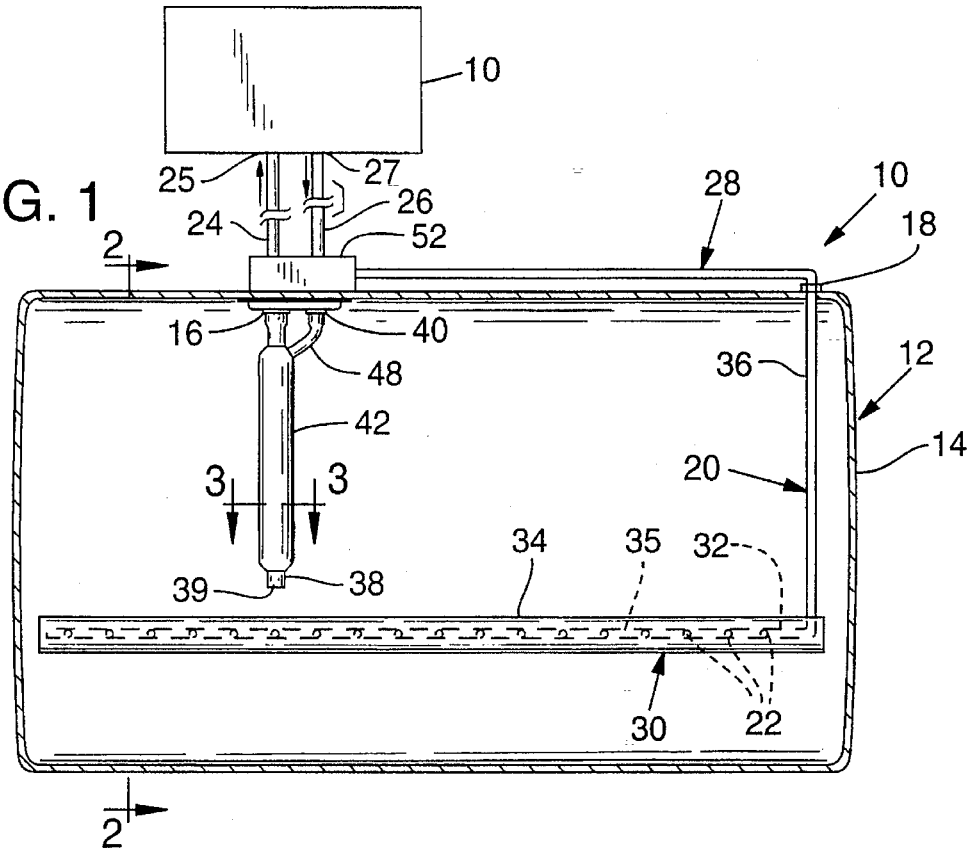
FIG. 1 is a cross-sectional side elevational view of a fuel system in accordance with one preferred embodiment of the present invention.

As shown generally in FIG. 1, a fuel system for an engine 10 of a motor vehicle has a fuel tank 12 with a wall 14. The fuel tank 12 is preferably cylindrical and elongated in a length dimension. The fuel tank may be attached longitudinally beneath the cab or otherwise mounted to the motor vehicle (not shown). However, it is to be understood that the present invention is applicable to any fuel tank geometry, location, or orientation.

Fuel is delivered from the fuel tank 12 to the engine 10 through a fuel delivery outlet 16. A fuel suction tube 38 typically extends from the fuel delivery outlet 16 downwardly toward the bottom of the fuel tank 12. The fuel suction tube 38 has a suction inlet 39. Fuel is drawn from the fuel tank 12 through the suction inlet 39 and the suction tube 38 for delivery to the engine. A fuel delivery conduit 24 coupled to the fuel delivery outlet 16 carries fuel from the fuel delivery outlet 16 to an engine fuel inlet 25 of the engine. A fuel return conduit 26 is provided for returning unused fuel from an engine fuel return outlet 27 to the fuel tank 12.

The returning warmed fuel may be delivered to a fuel cooling subsystem, to a fuel warming subsystem, or selectively delivered to either the warming subsystem or the cooling subsystem depending upon fuel temperature. In tropical or other warm climates, the fuel warming subsystem may be eliminated. Similarly, in arctic or other cold climates, the cooling subsystem may be eliminated. In other climates or applications, both warming and cooling subsystems may be included in combination with a mechanism for directing fuel between the warming and cooling subsystems depending upon the temperature of the fuel being delivered to the engine.

One such fuel flow directing mechanism comprises a valve 52. Valve 52 preferably comprises a temperature sensitive valve which delivers returning fuel to either a fuel cooling return inlet 18 or a fuel warming return inlet 40. In one preferred embodiment, the fuel warming return inlet 40 and the fuel delivery outlet 16 are positioned adjacent each other. Together, they are spaced apart from the fuel cooling return inlet 18, in this case located adjacent to one end of the fuel tank 12.

In accordance with one aspect of the present invention, the fuel system cools unused fuel that has been warmed by the engine, or engine equipment such as the electronic engine controls (not shown). In accordance with this aspect of the invention, a cooling subsystem is provided to cool the fuel. In one illustrated form, such a cooling subsystem may include a fuel cooling conduit 20 which is coupled to the fuel cooling return inlet 18. The fuel cooling conduit 20 includes an external fuel cooling tube 28, although tube 28 may be positioned inside the fuel tank, and a fuel dispersion portion 30. The illustrated fuel dispersion portion 30 has a fuel dispersion tube 32 with a plurality of fuel dispersion outlets 22 that preferably comprise conventional spray nozzles. For maximum efficiency, the fuel dispersion tube typically extends along about the entire length of the tank. Also, the nozzles are typically spaced an equal distance apart along the dispersion tube. For example, a 150 gallon fuel tank is typically about five and one-half feet long. In such a case, the dispersion tube may be about five feet long. Of course, it may be longer or shorter and need not be straight. Any number of nozzles may be used, providing that they are capable of spraying the volume of fuel returned from the engine. For example, a Detroit Diesel Series 60 engine at idle returns about 1.1 gallons of fuel per minute to the fuel tank. Therefore, if ten nozzles are used, each typically can deliver at least 0.11 gallons of fuel per minute at ordinary engine operating fuel pressures. Typically, the nozzles have an identical fuel delivery capacity, although this is not necessary. Also, the nozzles are typically oversized somewhat to have the capacity to deliver in excess of the maximum fuel that a particular engine will return to the fuel tank.

The fuel dispersion tube portion 32 extends along the length dimension of the fuel tank 12 near the top of the fuel tank (FIGS. 1 and 4). The nozzles are configured to direct fuel toward the fuel tank wall 14. Preferably, the nozzles spray the warm return fuel onto the fuel tank wall 14 near the top of the tank 12. The fuel tank wall 14 acts as a heat sink to cool the warm fuel as the fuel drains down the wall 14 to the level of the fuel stored within the tank 12. Spraying the warm fuel onto a top portion of the wall 14 increases the cooling of the fuel because the heat transfer of the fuel to the fuel tank wall 14 tends to increase as the drainage distance increases. Alternatively, the wall 14 may be in the form of a heat dissipation element, such as a plate, baffle or other surface, supported within the tank 12.

This specific embodiment also has an advantage in that fuel will drain over a greater distance down the fuel tank wall 14 as the level of fuel in the fuel tank 12 decreases. This increase in fuel cooling tends to counteract the decrease in fuel cooling associated with the shorter dwell time of fuel in the fuel tank storage when the tank fuel level is low.

In the embodiment shown in FIG. 1, the fuel dispersion portion 30 has an elongate frame or bracket 34 that supports the fuel dispersion tube 32 along the length dimension of the fuel tank 12. The bracket 34 has a flange 35 that is mounted to the fuel tank wall 14, above the fuel dispersion tube 32, by welding or any suitable fasteners. The bracket 34 is spaced from the fuel tank wall 14 and is positioned to support the fuel dispersion tube 32 from below. The fuel dispersion tube 32 is therefore supported in close proximity to the fuel tank wall and the nozzles 22 are oriented to spray fuel upwardly onto the fuel tank wall. The sprayed fuel drains down the wall 14, unimpeded by the elongate frame 34.

It is to be understood that the fuel cooling subsystem of the present invention may take a variety of forms. for example, the fuel dispersion tube 32 may directly abut the fuel tank wall 14 so that warm return fuel flows directly onto

FUEL SYSTEM FOR HEATING AND COOLING FUEL

TECHNICAL FIELD

The present invention relates to a fuel system for heating fuel, cooling fuel, or both heating and cooling fuel for the efficient operation of internal combustion engines.

BACKGROUND OF THE INVENTION

Engines, especially diesel engines, operate most efficiently when the fuel delivered to the engines is maintained within a desired temperature range. The low end of the desired range is above low fuel temperatures at which fuel may thicken (wax). The high end of the desired temperature range is below high fuel temperatures at which engine power output deteriorates.

Fuel waxing is apt to occur during cold weather, when the fuel tank of a vehicle is exposed to the environment. Under such conditions, fuel in the fuel tank may thicken. Such thickened fuel may clog the engine fuel inlet lines. The clogging may result in compromised engine performance or engine shutdown. The small fuel lines of electronic fuel injectors prevalent today are especially vulnerable to such clogging.

Engine power output may deteriorate when the fuel being delivered to the engine becomes excessively warm. For example, the power output of diesel engines may decline by one horsepower for every 10° F. of fuel temperature over 100° F. Moreover, over-heated fuel may be detrimental when fuel is used to cool engine equipment, such as in a heat exchange relationship with electronic engine controls. Such over-heated fuel may inadequately cool the engine equipment, resulting in a reduced service life for that equipment.

Fuel tends to become excessively heated when stored in a vehicle fuel tank during very hot weather. Fuel also becomes overheated when used to cool engine equipment. As much as 80% of the fuel directed from the fuel tank to the engine is returned unused (uncombusted) by the engine and is used for equipment cooling as the fuel is returned to the fuel tank. The fuel picks up heat from equipment being cooled, which tends to increase the temperature of the fuel.

Therefore, it is desirable to maintain the fuel delivered from the fuel tank within a temperature range that minimizes problems associated with waxing, degraded power output and inadequate engine equipment cooling.

One prior art approach uses radiators to cool the fuel. However, radiators tend to be expensive and prone to damage. Another approach uses a two fuel tank system to address the problem of hot fuel that is recycled from the engine. The first tank receives the hot recycled fuel for storage and gradual cooling, and the other tank receives cooled fuel from the first tank for delivery to the engine. This approach has a drawback in that, on very warm days, the fuel in the tanks may not cool adequately. Moreover, when the fuel level in the tanks is low, the hot fuel may not be stored in the cooling tank long enough for adequate cooling. Furthermore, these approaches do not address the problem of fuel that is too cold.

U.S. Pat. No. 4,748,968 to Wolf discloses a fuel heating device in which relatively hot engine coolant circulates around a fuel tank suction tube to warm fuel taken from the fuel tank. The Wolf device requires a coolant fluid circuit extending between the cooling system and the fuel tank.

U.S. Pat. No. 5,042,447 to Stone discloses a thermostatically controlled fuel heater and cooler. The Stone device monitors the fuel temperature and appropriately directs the fuel into a fuel heating heat exchanger utilizing relatively hot engine coolant for heating, or a fuel cooling heat exchanger utilizing a refrigerant for cooling. The coolant and refrigerant of the Stone device circulate through lines which are linked into the engine cooling system, and the air conditioning system, respectively. Consequently, the Stone device adds to the complexity of these systems.

A need exists for an improved apparatus for temperature control of fuel which overcomes these and other disadvantages of the prior art.

SUMMARY OF THE INVENTION

It is one object of the present invention to provide an improved fuel system for adjusting fuel temperature of fuel utilized by an internal combustion engine.

It is another object of the present invention to either heat fuel utilized by an engine, cool fuel utilized by an engine, or selectively heat or cool fuel utilized by an engine.

A secondary object of the present invention is to provide such a fuel system of simple construction.

Another secondary objective of this invention is to provide a fuel system for fuel cooling and/or heating that is concealed within a fuel tank for protection against damage.

A fuel system in accordance with one aspect of the present invention has a fuel tank with a fuel delivery outlet through which fuel is delivered to an engine. The fuel tank has a fuel cooling return inlet through which unused fuel warmed by the engine is returned to the fuel tank. A fuel cooling conduit may be coupled to the fuel cooling return inlet. The fuel cooling conduit has at least one fuel dispersing outlet through which fuel is dispersed against a heat dissipation surface, such as a wall of the fuel tank, to cool the fuel.

The fuel tank may have a fuel suction tube extending from the fuel delivery outlet into the fuel tank. Fuel is drawn to the engine from the fuel tank through the suction tube and the fuel delivery outlet. The tank has a fuel warming return inlet through which unused fuel warmed by the engine may be returned to the fuel tank. The warmed fuel may be guided by a fuel flow guide to blend with and heat fuel from the tank which is then delivered to the fuel delivery outlet and to the engine. Preferably, the unused warm fuel passes in heat transfer relationship to the suction tube so as to heat the fuel in the suction tube.

In accordance with another aspect of the present invention, a shroud may be provided over a portion of the fuel warming conduit and suction tube. The shroud defines a blending chamber in which heated fuel returning from the engine is blended with cooler fuel from the fuel tank. The warm fuel blend is then directed into the suction tube for delivery to the engine.

The present invention relates to the above-described objects and features individually, as well as collectively. These and other features, objects and advantages of the present invention will become apparent with reference to the following description and drawings.

BRIEF DESCRIPTION OF DRAWINGS

FIG. 1 is a cross-sectional side elevational view of a fuel system in accordance with one preferred embodiment of the present invention.

Figure 2:
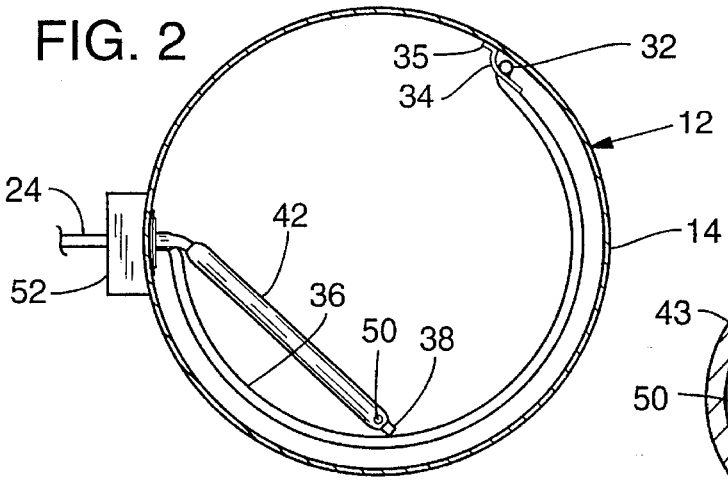
FIG. 2 is a cross-sectional end view of the fuel system in accordance with one preferred embodiment of the present invention, taken along line 2—2 of FIG. 1.

FIG. 2 is a cross-sectional end view of the fuel system in accordance with one preferred embodiment of the present invention, taken along line 2—2 of FIG. 1.

Figure 3:
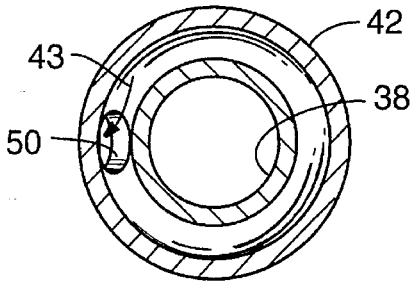
FIG. 3 is a cross-sectional view of a fuel warming portion of a fuel system in accordance with one preferred embodiment of the present invention, taken along line 3—3 of FIG. 1.

FIG. 3 is a cross-sectional view of a fuel warming portion of a fuel system in accordance with one preferred embodiment of the present invention, taken along line 3—3 of FIG. 1.

FIG. 4 is a cutaway perspective view of the fuel system in accordance with one preferred embodiment of the present invention, with the outline of a portion of a fuel tank being shown in dashed lines.

FIG. 5 is a cutaway, cross-sectional side elevational view of a fuel system in accordance with one preferred embodiment of the present invention.

Figure 6:
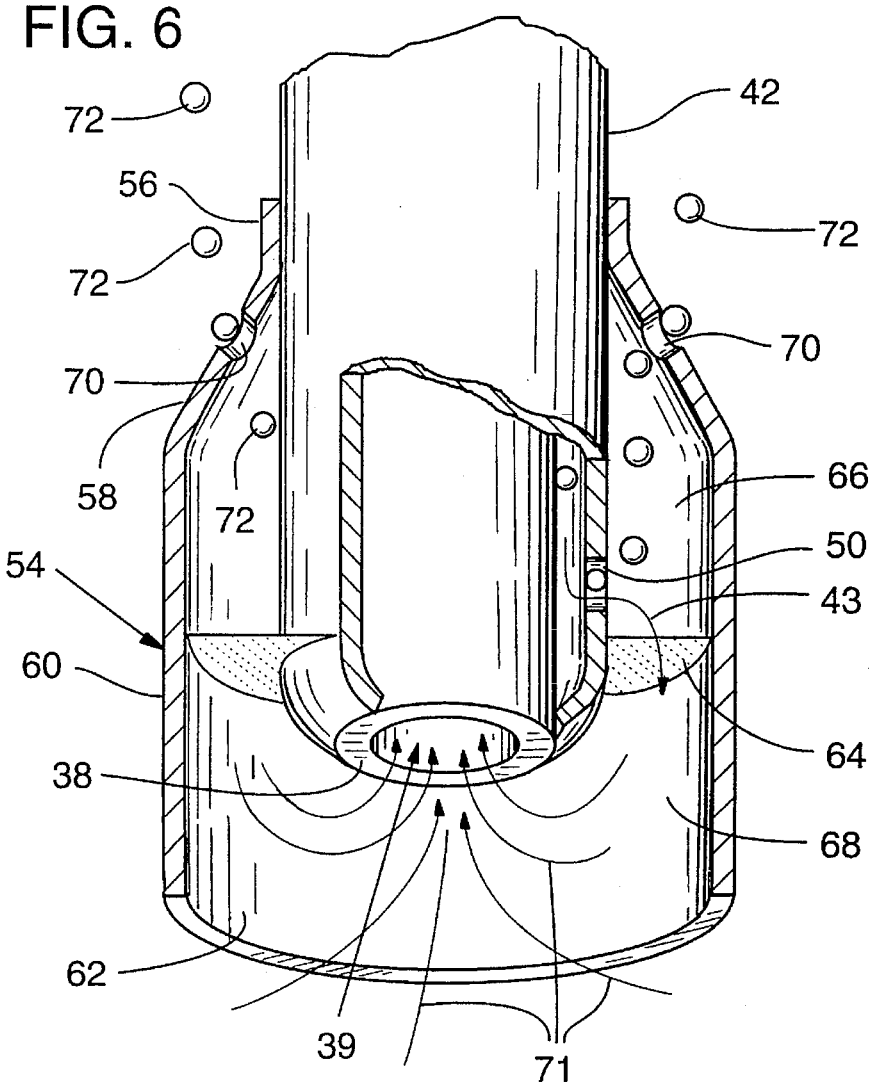
FIG. 6 is a cutaway side elevational view of the fuel system in accordance with a preferred embodiment of the present invention, showing the provision of an optional shroud.

FIG. 6 is a cutaway side elevational view of the fuel system in accordance with a preferred embodiment of the present invention, showing the provision of an optional shroud.

Figure 7:
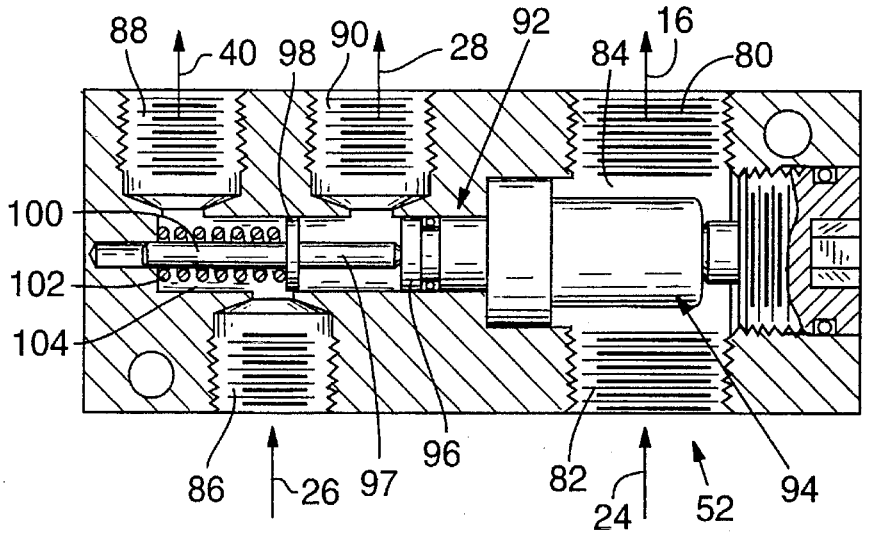
FIG. 7 is a cross-sectional view of one form of valve suitable for use in embodiments of the present invention.

FIG. 7 is a cross-sectional view of one form of valve suitable for use in embodiments of the present invention.

DETAILED DESCRIPTION

As shown generally in FIG. 1, a fuel system for an engine 10 of a motor vehicle has a fuel tank 12 with a wall 14. The fuel tank 12 is preferably cylindrical and elongated in a length dimension. The fuel tank may be attached longitudinally beneath the cab or otherwise mounted to the motor vehicle (not shown). However, it is to be understood that the present invention is applicable to any fuel tank geometry, location, or orientation.

Fuel is delivered from the fuel tank 12 to the engine 10 through a fuel delivery outlet 16. A fuel suction tube 38 typically extends from the fuel delivery outlet 16 downwardly toward the bottom of the fuel tank 12. The fuel suction tube 38 has a suction inlet 39. Fuel is drawn from the fuel tank 12 through the suction inlet 39 and the suction tube 38 for delivery to the engine. A fuel delivery conduit 24 coupled to the fuel delivery outlet 16 carries fuel from the fuel delivery outlet 16 to an engine fuel inlet 25 of the engine. A fuel return conduit 26 is provided for returning unused fuel from an engine fuel return outlet 27 to the fuel tank 12.

The returning warmed fuel may be delivered to a fuel cooling subsystem, to a fuel warming subsystem, or selectively delivered to either the warming subsystem or the cooling subsystem depending upon fuel temperature. In tropical or other warm climates, the fuel warming subsystem may be eliminated. Similarly, in arctic or other cold climates, the cooling subsystem may be eliminated. In other climates or applications, both warming and cooling subsystems may be included in combination with a mechanism for directing fuel between the warming and cooling subsystems depending upon the temperature of the fuel being delivered to the engine.

One such fuel flow directing mechanism comprises a valve 52. Valve 52 preferably comprises a temperature sensitive valve which delivers returning fuel to either a fuel cooling return inlet 18 or a fuel warming return inlet 40. In one preferred embodiment, the fuel warming return inlet 40 and the fuel delivery outlet 16 are positioned adjacent each other. Together, they are spaced apart from the fuel cooling return inlet 18, in this case located adjacent to one end of the fuel tank 12.

In accordance with one aspect of the present invention, the fuel system cools unused fuel that has been warmed by the engine, or engine equipment such as the electronic engine controls (not shown). In accordance with this aspect of the invention, a cooling subsystem is provided to cool the fuel. In one illustrated form, such a cooling subsystem may include a fuel cooling conduit 20 which is coupled to the fuel cooling return inlet 18. The fuel cooling conduit 20 includes an external fuel cooling tube 28, although tube 28 may be positioned inside the fuel tank, and a fuel dispersion portion 30. The illustrated fuel dispersion portion 30 has a fuel dispersion tube 32 with a plurality of fuel dispersion outlets 22 that preferably comprise conventional spray nozzles. For maximum efficiency, the fuel dispersion tube typically extends along about the entire length of the tank. Also, the nozzles are typically spaced an equal distance apart along the dispersion tube. For example, a 150 gallon fuel tank is typically about five and one-half feet long. In such a case, the dispersion tube may be about five feet long. Of course, it may be longer or shorter and need not be straight. Any number of nozzles may be used, providing that they are capable of spraying the volume of fuel returned from the engine. For example, a Detroit Diesel Series 60 engine at idle returns about 1.1 gallons of fuel per minute to the fuel tank. Therefore, if ten nozzles are used, each typically can deliver at least 0.11 gallons of fuel per minute at ordinary engine operating fuel pressures. Typically, the nozzles have an identical fuel delivery capacity, although this is not necessary. Also, the nozzles are typically oversized somewhat to have the capacity to deliver in excess of the maximum fuel that a particular engine will return to the fuel tank.

The fuel dispersion tube portion 32 extends along the length dimension of the fuel tank 12 near the top of the fuel tank (FIGS. 1 and 4). The nozzles are configured to direct fuel toward the fuel tank wall 14. Preferably, the nozzles spray the warm return fuel onto the fuel tank wall 14 near the top of the tank 12. The fuel tank wall 14 acts as a heat sink to cool the warm fuel as the fuel drains down the wall 14 to the level of the fuel stored within the tank 12. Spraying the warm fuel onto a top portion of the wall 14 increases the cooling of the fuel because the heat transfer of the fuel to the fuel tank wall 14 tends to increase as the drainage distance increases. Alternatively, the wall 14 may be in the form of a heat dissipation element, such as a plate, baffle or other surface, supported within the tank 12.

This specific embodiment also has an advantage in that fuel will drain over a greater distance down the fuel tank wall 14 as the level of fuel in the fuel tank 12 decreases. This increase in fuel cooling tends to counteract the decrease in fuel cooling associated with the shorter dwell time of fuel in the fuel tank storage when the tank fuel level is low.

In the embodiment shown in FIG. 1, the fuel dispersion portion 30 has an elongate frame or bracket 34 that supports the fuel dispersion tube 32 along the length dimension of the fuel tank 12. The bracket 34 has a flange 35 that is mounted to the fuel tank wall 14, above the fuel dispersion tube 32, by welding or any suitable fasteners. The bracket 34 is spaced from the fuel tank wall 14 and is positioned to support the fuel dispersion tube 32 from below. The fuel dispersion tube 32 is therefore supported in close proximity to the fuel tank wall and the nozzles 22 are oriented to spray fuel upwardly onto the fuel tank wall. The sprayed fuel drains down the wall 14, unimpeded by the elongate frame 34.

It is to be understood that the fuel cooling subsystem of the present invention may take a variety of forms. for example, the fuel dispersion tube 32 may directly abut the fuel tank wall 14 so that warm return fuel flows directly onto cooling return inlet 18 or the fuel warming return inlet 40, depending on fuel temperature.

It is to be understood that other valves or flow diverters may be used with this invention. For instance, the valve may be manually activated (remotely from the cab of a vehicle or by a manual switch on the valve). Also, the valve may take the form of a solenoid operated valve which is operated in response to sensed fuel temperature.

It is to be understood that the first and second predetermined magnitudes are exemplary only. These temperatures may be modified for different grades of fuel, including diesel fuel, kerosene, and gasoline. The fuel system of the present invention is applicable to any type of internal combustion engine, but has particular applicability to diesel engines. The fuel cooling feature is also particularly applicable to gasoline engines.

Again, it is to be understood that the heating and cooling aspects of this invention may be separately provided or provided in combination. For example, in hot climates, only fuel cooling may be necessary.

This detailed description is set forth only for purposes of illustrating examples of the present invention and should not be considered to limit the scope of the claims to the invention in any way. Numerous additions, substitutions, and modifications can be made to these examples without departing from the scope of the invention. I claim any and all modifications that fall within the scope of the following claims.

I claim:

1. A fuel system for an engine of a motor vehicle comprising:

a fuel tank;

a fuel delivery flow path along which fuel from the fuel tank is delivered to an engine;

a fuel return flow path along which unused fuel warmed by the engine is returned to the fuel tank; and a heat exchanger in the fuel tank and in the fuel return flow path for cooling fuel returning to the fuel tank, the heat exchanger in the fuel tank and in the fuel return flow path having a heat dissipation surface within the fuel tank against which fuel returning along the fuel return flow path is dispersed.

2. A fuel system for an engine of a motor vehicle comprising:

a fuel tank having a wall, a fuel delivery outlet through which fuel flows to the engine, and a fuel cooling return inlet through which unused fuel warmed by the engine may be returned to the fuel tank from the engine; and a fuel cooling conduit coupled to the fuel cooling return inlet, the fuel cooling conduit having at least one fuel dispersing outlet through which fuel is dispersed toward the wall to cool the fuel, and the fuel cooling conduit having a fuel dispersion portion with plural fuel dispersing outlets positioned in an upper region of the fuel tank.

3. A fuel system according to claim 2 in which the fuel tank is elongated in a length dimension, and wherein the fuel dispersion portion extends along the length dimension of the fuel tank.

4. A fuel system according to claim 2 in which the fuel cooling conduit comprises a fuel cooling tube, the fuel dispersion portion comprising a fuel dispersion tube portion of the fuel cooling tube, and the fuel dispersing outlets comprising plural nozzles directed toward the wall.

5. A fuel system according to claim 4 in which the fuel cooling return inlet is positioned in an upper region of the fuel tank at a location spaced from the fuel delivery outlet and wherein the fuel cooling tube includes a connecting tube portion extending from the fuel cooling return inlet to the fuel dispersion tube portion, the connecting tube portion extending downwardly from the fuel cooling return inlet, transversely across the fuel tank, and upwardly along the fuel tank to a location spaced from the fuel cooling return inlet and to the fuel dispersion tube portion, the fuel tank being elongated in a length dimension, and the fuel dispersion tube portion extending along the length dimension of the fuel tank.

6. A fuel system for an engine of a motor vehicle comprising:

a fuel tank having a wall, a fuel delivery outlet through which fuel flows to the engine, and a fuel cooling return inlet through which unused fuel warmed by the engine may be returned to the fuel tank from the engine; and a fuel cooling conduit coupled to the fuel cooling return inlet, the fuel cooling conduit having at least one fuel dispersing outlet oriented through which fuel is dispersed toward the wall to cool the fuel; and a fuel suction tube extending into the fuel tank from the fuel delivery outlet, fuel being drawn to the engine from the fuel tank through the suction tube and the fuel delivery outlet, the fuel system having a fuel warming return inlet through which unused fuel may be returned to the fuel tank from the engine, the fuel warming return inlet directing fuel to flow adjacent to the suction tube such that fuel warmed by the engine and returning to the fuel tank through the fuel warming return inlet heats the fuel being delivered through the suction tube and the fuel delivery outlet to the engine, and a valve operable to selectively direct the flow of fuel returning from the engine to the fuel cooling return inlet or the fuel warming return inlet.

7. A fuel system according to claim 6 in which the fuel warming return inlet is spaced from the fuel cooling return inlet.

8. A fuel system according to claim 6 in which the fuel warming return inlet includes a heat exchanger which transfers heat from fuel returning to the fuel warming return inlet to fuel passing through the suction tube.

9. A fuel system according to claim 8 in which the heat exchanger comprises a fuel warming conduit coupled to the fuel warming return inlet and extending along a length of the suction tube.

10. A fuel system according to claim 9 in which the fuel warming conduit surrounds the suction tube and defines a warm fuel return path between the suction tube and fuel warming conduit.

11. A fuel system according to claim 10 wherein fuel enters the suction tube along a suction flow path, and wherein the fuel warming conduit directs at least a portion of the warm fuel in the warm fuel return path to the suction flow path.

12. A fuel system according to claim 6 in which the valve comprises a temperature sensing valve operable to direct fuel to the fuel cooling return inlet when the temperature of the fuel at the fuel delivery outlet is above a first predetermined magnitude and to direct fuel to the fuel warming return inlet when the fuel temperature of the fuel at the fuel delivery outlet is below a second predetermined magnitude which is less than the first predetermined magnitude.

13. A fuel system according to claim 12 wherein the first predetermined magnitude is about 80° F. and wherein the second predetermined magnitude is about 60° F.

14. A fuel system for an engine of a motor vehicle comprising:

a fuel tank having a wall, a fuel delivery outlet through which fuel flows to the engine, and a fuel warming return inlet through which unused fuel warmed by the engine is returned to the fuel tank from the engine;

a fuel suction tube extending into the fuel tank from the fuel delivery outlet, the suction tube having a suction tube opening, fuel being drawn to the engine from the fuel tank through the suction tube opening and the fuel delivery outlet; and a warm fuel flow guide positioned to direct the flow of unused warm fuel past and in contact with at least a portion of the suction tube such that fuel warmed by the engine and returning to the fuel tank heats the fuel being delivered through the suction tube and the fuel delivery outlet to the engine, the warm fuel flow guide having a fuel outlet aperture positioned above the suction tube opening such that bubble forming vapor in the returning warm fuel exiting the fuel outlet aperture can float upwardly away from the suction tube opening.

15. A fuel system for an engine of a motor vehicle comprising:

a fuel tank having a wall, a fuel delivery outlet through which fuel flows to the engine, and a fuel warming return inlet through which unused fuel warmed by the engine is returned to the fuel tank from the engine;

a fuel suction tube extending into the fuel tank from the fuel delivery outlet, the fuction tube having a suction tube inlet, fuel being drawn to the engine from the fuel tank through the suction tube inlet and suction tube and the fuel delivery outlet; and a warm fuel flow guide positioned to direct the flow of unused warm fuel past at least a portion of the suction tube such that fuel warmed by the engine and returning to the fuel tank heats the fuel being delivered through the suction tube and the fuel delivery outlet to the engine, the warm fuel flow guide having a warm fuel opening oriented to direct the returning warm fuel away from the direct flow path of fuel entering the suction tube inlet so as to divert vapor bubbles in the returning warm fuel away from the suction tube inlet, the warm fuel flow guide also blending unused warm fuel with the fuel entering the suction tube for delivery through the suction tube to the engine.

16. A fuel system according to claim 15 which includes a shroud into which fuel flowing through the warm fuel opening is delivered, the shroud having a shroud, opening above the warm fuel opening.

17. A fuel system according to claim 16, in which the shroud includes a screen below the warm fuel opening.

18. A fuel system according to claim 2 in which plural fuel dispersion outlets are directed toward an outbound portion of the fuel tank wall.

19. A fuel system for an engine of a motor vehicle comprising:

a fuel tank having a wall, a fuel delivery outlet through which fuel flows to the engine, and a fuel warming return inlet through which unused fuel warmed by the engine is returned to the fuel tank from the engine;

a fuel suction tube extending into the fuel tank from the fuel delivery outlet, fuel being drawn to the engine from the fuel tank through the suction tube and the fuel delivery outlet; and a warm fuel flow guide positioned to direct the flow of unused warm fuel past at least a portion of the suction tube such that fuel warmed by the engine and returning to the fuel tank heats the fuel being delivered through the suction tube and the fuel delivery outlet to the engine, the warm fuel flow guide having a heat exchanger which transfers heat from fuel returning to the fuel warming return inlet to fuel passing through the suction tube, the heat exchanger having a fuel warming conduit coupled to the fuel warming return inlet and extending along a length of the suction tube, the fuel warming conduit surrounding the suction tube and defining a warm fuel return flow path between the suction tube and fuel warming conduit; and the fuel warming conduit and suction tube terminating in a distal end spaced from the fuel delivery outlet, the system including a shroud mounted to the distal end of the fuel warming conduit, the shroud defining a fuel mixing chamber communicating with the fuel warming conduit, the fuel tank, and with the interior of the suction tube within which unused warm fuel from the fuel warming conduit is mixed with fuel from the fuel tank being delivered to the fuel suction tube.

20. A fuel system for an engine of a motor vehicle comprising:

a fuel tank having a wall, a fuel delivery outlet through which fuel flows to the engine, and a fuel warming return inlet through which unused fuel warmed by the engine is returned to the fuel tank from the engine;

a fuel suction tube extending into the fuel tank from the fuel delivery outlet, the fuel suction tube having a suction tube inlet, and fuel being drawn to the engine from the fuel tank through the suction tube and the fuel delivery outlet; and a fuel mixer within the fuel tank which directs and blends unused warm fuel returning to the fuel tank with fuel from the fuel tank being drawn through the suction tube, the fuel mixer having a barrier between the fuel warming return inlet and the suction tube inlet which prevents a portion of the unused warm fuel returning to the fuel tank from mixing with fuel from the fuel tank being drawn through the suction tube.

21. A fuel system for an engine of a motor vehicle comprising:

a fuel tank having a wall, a fuel delivery outlet through which fuel flows to the engine, and a fuel cooling return inlet through which unused fuel warmed by the engine may be returned to the fuel tank from the engine;

a fuel cooling tube coupled to the fuel cooling return inlet, the fuel cooling tube having a fuel dispersing tube portion with plural fuel dispersing outlets through which fuel is dispersed toward a portion of the fuel tank wall at an upper portion of the fuel tank;

the fuel cooling conduit includes a nozzle at each fuel dispersing outlet through which fuel is sprayed toward the fuel tank wall;

wherein the fuel tank is elongated in a length dimension and the fuel dispersing tube portion extends along the length dimension of the fuel tank;

the fuel system also including a fuel suction tube extending into the fuel tank from the fuel delivery outlet, fuel being drawn to the engine from the fuel tank through the suction tube and the fuel delivery outlet, the fuel system having a fuel warming return inlet through which unused fuel may be returned to the fuel tank from the engine, the fuel warming return inlet directing fuel to flow adjacent to the suction tube such that fuel warmed by the engine returning through the fuel warming return inlet heats fuel being delivered to the engine through the fuel delivery outlet; and a valve which directs the flow of fuel returning from the engine between the fuel cooling return inlet and the fuel warming return inlet.

22. A fuel system according to claim 21 in which the fuel warming return inlet includes a heat exchanger to transfer heat from the fuel returning to the fuel warming return inlet to fuel passing through the suction tube.

23. A fuel system according to claim 22 in which the heat exchanger comprises a fuel warming conduit surrounding the suction tube and defining a warm fuel return path between the suction tube and fuel warming conduit.

24. A fuel system according to claim 21 in which the fuel cooling return inlet is spaced from the fuel delivery outlet.

25. A fuel system according to claim 24 in which the valve comprises a temperature sensing valve operable to direct fuel to the fuel cooling return inlet when the temperature of the fuel at the fuel delivery outlet is above a first predetermined magnitude and to direct fuel to the fuel warming return inlet when the fuel temperature of the fuel at the fuel delivery outlet is below a second predetermined magnitude.

26. A fuel system for motor vehicles comprising:

an engine of the type with a fuel inlet for receiving fuel from a fuel tank for combustion by the engine and a fuel return outlet through which unused fuel warmed by the engine is returned;

a fuel tank, a fuel return inlet and a fuel delivery outlet;

an engine fuel delivery line coupling the engine fuel inlet to the fuel delivery outlet through which fuel from the fuel tank is delivered to the engine;

a fuel return line coupling the engine return outlet and fuel return inlet through which unused warmed fuel from the engine is returned to the fuel tank; and a fuel flow guide supported within the fuel tank in a position to blend unused warm fuel from the engine and fuel return inlet with fuel from the fuel tank being delivered to the fuel delivery outlet, the fuel flow guide having a warm return fuel tank inlet aperture through which warm return fuel the flow guide passes into the fuel, tank and an engine fuel inlet aperture through which fuel from the fuel tank passes into the flow guide, the fuel tank inlet aperture being directed away from the engine fuel inlet aperture.

27. A fuel system for motor vehicles comprising:

an engine of the type with a fuel inlet for receiving fuel from a fuel tank for combustion by the engine and a fuel return outlet through which unused fuel warmed by the engine is returned;

a fuel tank, a fuel return inlet and a fuel delivery outlet;

an engine fuel delivery line coupling the engine fuel inlet to the fuel delivery outlet through which fuel from the fuel tank is delivered to the engine;

a fuel return line coupling the engine return outlet and fuel return inlet through which unused warmed fuel from the engine is returned to the fuel tank; and a fuel flow guide supported within the fuel tank in a position to blend unused warm fuel from the engine and fuel return inlet with fuel from the fuel tank being delivered to the fuel delivery outlet;

the fuel flow guide having a fuel suction tube extending into the fuel tank from the fuel delivery outlet, the suction tube having a suction inlet, and fuel being delivered to the engine fuel delivery line from the fuel tank through the suction inlet;

the fuel flow guide being positioned and shaped to direct the flow of unused warm fuel from the fuel return inlet in direct heat transfer relationship to the suction tube such that fuel warmed by the engine and returning to the fuel tank through the fuel warming return inlet heats the fuel being delivered through the suction tube to the fuel delivery outlet and to the engine; and a screen provided within the fuel flow guides between the fuel return inlet and the suction inlet, the screen permitting warm return fuel to pass therethrough to blend with the fuel being delivered to the fuel delivery outlet.

28. A fuel system for motor vehicles comprising:

an engine of the type with a fuel inlet for receiving fuel from a fuel tank for combustion by the engine and a fuel return outlet through which unused fuel warmed by the engine is returned;

a fuel tank, a fuel return inlet and a fuel delivery outlet;

an engine fuel delivery line coupling the engine fuel inlet to the fuel delivery outlet through which fuel from the fuel tank is delivered to the engine;

a fuel return line coupling the engine return outlet and fuel return inlet through which unused warmed fuel from the engine is returned to the fuel tank;

a fuel flow guide supported within the fuel tank in a position to blend unused warm fuel from the engine and fuel return inlet with fuel from the fuel tank being delivered to the fuel delivery outlet, the fuel flow guide being positioned and shaped to direct the flow of unused warm fuel from the fuel return inlet in heat transfer relationship to the suction tube such that fuel warmed by the engine and returning to the fuel tank through the fuel warming return inlet heats the fuel being delivered through the suction tube to the fuel delivery outlet and to the engine;

a fuel suction tube extending into the fuel tank from the fuel delivery outlet, the suction tube having a suction inlet, and fuel being delivered to the engine fuel delivery line from the fuel tank through the suction inlet;

the fuel flow guide having a fuel warming conduit surrounding a length of the suction tube and defining a warm fuel return path, the fuel warming conduit having a fuel warming outlet aperture, the warm fuel return path passing through the fuel warming outlet aperture; and a shroud coupled to the fuel warming conduit and defining a fuel blending chamber communicating with the suction inlet, the fuel tank and the fuel warming outlet aperture, whereby unused warm fuel is blended with fuel from the fuel tank in the fuel blending chamber.

29. A fuel system according to claim 28 including a screen positioned within the shroud, between the fuel warming outlet aperture and the suction inlet, the warm fuel return path passing from the warming outlet aperture through the screen to the fuel blending chamber.

30. A fuel system according to claim 29 wherein the suction tube and the fuel warming conduit extend downwardly into the fuel tank; and the shroud is provided with at least one vapor aperture, the vapor aperture being positioned above the fuel warming outlet aperture and the screen to permit the escape of fuel vapor bubbles into the fuel tank through the fuel warming outlet aperture.

* * * * *